US009162501B2

(12) United States Patent
Omori

(10) Patent No.: US 9,162,501 B2
(45) Date of Patent: Oct. 20, 2015

(54) PRINTER HAVING A PLURALITY OF PAPER ROLLS EACH HAVING A SENSOR

(75) Inventor: Yohei Omori, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 428 days.

(21) Appl. No.: 13/196,228

(22) Filed: Aug. 2, 2011

(65) Prior Publication Data

US 2012/0051824 A1 Mar. 1, 2012

(30) Foreign Application Priority Data

Aug. 25, 2010 (JP) ..... 2010-188433

(51) Int. Cl.

| | |
|---|---|
| ***B41J 15/04*** | (2006.01) |
| ***B41J 29/38*** | (2006.01) |
| ***B41J 15/22*** | (2006.01) |
| ***B41J 11/00*** | (2006.01) |
| ***B41J 15/18*** | (2006.01) |

(52) U.S. Cl.

CPC ..... *B41J 15/22* (2013.01); *B41J 11/003* (2013.01); *B41J 11/009* (2013.01); *B41J 11/0075* (2013.01); *B41J 15/04* (2013.01); *B41J 15/18* (2013.01); *B41J 29/38* (2013.01)

(58) Field of Classification Search

CPC ..... G03G 15/652; G03G 2215/00455
USPC ..... 400/611, 613; 347/104; 399/384, 385
See application file for complete search history.

(56) References Cited

U.S. PATENT DOCUMENTS

| | | | | |
|---|---|---|---|---|
| 4,885,613 | A * | 12/1989 | Kudoh | 399/23 |
| 6,595,463 | B2 * | 7/2003 | Miyazaki | 242/598.2 |
| 2009/0103123 | A1 * | 4/2009 | Ikedo et al. | 358/1.12 |

FOREIGN PATENT DOCUMENTS

| | | | | |
|---|---|---|---|---|
| JP | 63154567 | A * | 6/1988 | B65H 26/08 |
| JP | 04321364 | A * | 11/1992 | H04N 1/00 |
| JP | 08073080 | A * | 3/1996 | B65H 19/10 |
| JP | 08175709 | A * | 7/1996 | B41J 15/00 |
| JP | 09048544 | A * | 2/1997 | B65H 26/08 |
| JP | 2848062 | B2 | 1/1999 | |
| JP | 2001106403 | A * | 4/2001 | B65H 23/182 |
| JP | 2002128337 | A * | 5/2002 | B65H 20/00 |
| JP | 2004136514 | A * | 5/2004 | B41J 15/04 |
| JP | 2004168514 | A * | 6/2004 | B65H 19/12 |
| JP | 2005111707 | A * | 4/2005 | B41J 2/01 |
| JP | 2005119802 | A * | 5/2005 | B65H 26/00 |
| JP | 2005306524 | A * | 11/2005 | B65H 26/00 |
| JP | 2006-268430 | A | 10/2006 | |

* cited by examiner

*Primary Examiner* — Daniel J Colilla
(74) *Attorney, Agent, or Firm* — Fitzpatrick, Cella, Harper & Scinto

(57) ABSTRACT

A printing apparatus has a mounting unit configured to support a plurality of roll papers at a plurality of mounting positions, an obtaining unit configured to obtain information of individual roll paper supported by the mounting unit, and a printing unit configured to print an image on a sheet selectively pulled out from the plurality of roll of papers. In the case that another roll paper is mounted at one of the plurality of mounting positions while the printing unit prints the image on one of the plurality of roll papers supported by the mounting unit, the obtaining unit obtains information of the another roll paper.

31 Claims, 9 Drawing Sheets

DIAMETER OF ROLL R = CONVEYANCE AMOUNT OF PAPER/
(SIGNAL VALUE READ BY ENCODER DURING CONVEYANCE/ SIGNAL VALUE READ BY ENCODER PER ONE ROTATION OF ROLL PAPER × $\pi$)
($\pi$: CIRCULAR CONSTANT)

FIG.8A

TABLE OF RELATION BETWEEN ROLL DIAMETER $\phi$ AND ROLL REMAINING AMOUNT

| ROLL DIAMETER (mm) | ROLL REMAINING AMOUNT (m) |
|---|---|
| $200 \leqq \phi$ | 200 |
| $150 \leqq \phi < 200$ | 160 |
| ⋮ | ⋮ |
| $\phi < 50$ | 0 |

FIG.8B

PRINTER HAVING A PLURALITY OF PAPER ROLLS EACH HAVING A SENSOR

BACKGROUND OF THE INVENTION

1. Field of the Invention

The present invention relates to a printing apparatus capable of printing on a plurality of rolls of paper each fed through a different conveyance path. Specifically, the invention relates to a method of detecting information concerning a newly mounted roll of paper even when another roll of paper is being conveyed without suspending the conveyance operation.

2. Description of the Related Art

Some printing apparatuses which performs printing on a continuous sheet wound in a roll-shape (hereinafter, referred to as roll of paper) are designed to mount a plurality of rolls of paper the type and/or size of which are different from each other. In such a printing apparatus, printing of an image is selectively carried out on either one of the rolls of paper. These rolls of paper are fed out through a different conveyance path respectively, and then into a common conveyance path. The printing is carried out on the roll of paper in the common conveyance path. Before carrying out the printing of an image, the printing apparatus has to obtain information concerning type, size or the like of the roll of paper to be printed. Conventionally, there are known as the obtaining methods, a method in which information is input by a user using an inputting means, or a method in which the information is obtained by a sensor provided on a printing apparatus.

For example, Japanese Patent Publication No. 02848062 discloses, in the specification thereof, an arrangement in which, every time a new roll of paper is mounted, the size of the paper is recognized based on both of information input by a user and detection result by a sensor disposed within a common conveyance path for a plurality of rolls of paper.

However, according to the apparatus described in the specification of Japanese Patent Publication No. 02848062, the roll of paper is conveyed into a common conveyance path, and the size of the paper is detected by the sensor disposed on the common conveyance path. Therefore, during printing on one roll of paper or conveying thereof, the size of another roll of paper cannot be detected. That is, when a new roll of paper is mounted during printing on a roll of paper, the information concerning the newly mounted roll of paper cannot be obtained until the printing on the other roll of paper is completed. Since the information of the new roll of paper is obtained after the printing on the proceeding roll of paper has completed, a certain time is required for conveying the new roll of paper and detecting information thereof, and thus the user has to wait for the completion of the conveyance and detection.

SUMMARY OF THE INVENTION

The invention has been proposed in order to solve the above-described disadvantage. Therefore, an object of the invention is to provide a printing apparatus which is capable of mounting a plurality of rolls of paper and which is able to obtain, even during printing on one roll of paper or conveying thereof, the information concerning another newly mounted roll of paper.

In a first aspect of the present invention, there is provided a printing apparatus, comprising: a mounting unit configured for mounting a plurality of rolls of paper at a plurality of mounting positions; a plurality of separate conveyance paths each configured to exclusively convey therethrough each of sheets pulled out from the plurality of mounted rolls of paper; a plurality of roll paper information obtaining units each configured to detect the roll paper from each of the mounting positions in the separate conveyance path and thereby to obtain individual roll paper information; a conveyance path merging part at which the separate conveyance paths merge with each other; and a printing unit located downstream of the conveyance path merging part in a conveyance direction and configured to print an image on a sheet selectively pulled out from the plurality of roll of papers, wherein, while the printing unit prints the image on one of the plurality of roll papers, the roll paper information obtaining unit obtains the roll paper information of another one of the plurality of roll papers.

In a second aspect of the present invention, there is provided a method of obtaining roll paper information, comprising: a separate conveyance step of conveying each of sheets pulled out from a plurality of mounted rolls of paper through a dedicated separate conveyance path; a roll paper information obtaining step of obtaining individual roll paper information by detecting the roll paper in the separate conveyance step; and a printing step of printing an image on a sheet selectively pulled out from the plurality of rolls of paper downstream of a conveyance path merging part at which the separate conveyance paths merge with each other in a conveyance direction, wherein, during the printing step on one of the plurality of roll papers, the roll paper information obtaining step is carried out to obtain the roll paper information of another one of the plurality of roll papers.

Further features of the present invention will become apparent from the following description of exemplary embodiments (with reference to the attached drawings).

BRIEF DESCRIPTION OF THE DRAWINGS

FIG. 8A is a formula for calculating a diameter of a roll of paper;

FIG. 8B shows a table storing values of remaining amount of roll of paper corresponding to the diameter.

DESCRIPTION OF THE EMBODIMENTS

An embodiment of the invention will be described below while taking an ink-jet printing apparatus as an example. An ink-jet printing apparatus of the embodiment is a high-speed line printer capable of performing both of single-sided printing and double-sided printing on a continuous sheet which is wound in a roll-shape. It is suitable, for example, for printing a large number of sheets in a print-labo or the like.

Figure 1:
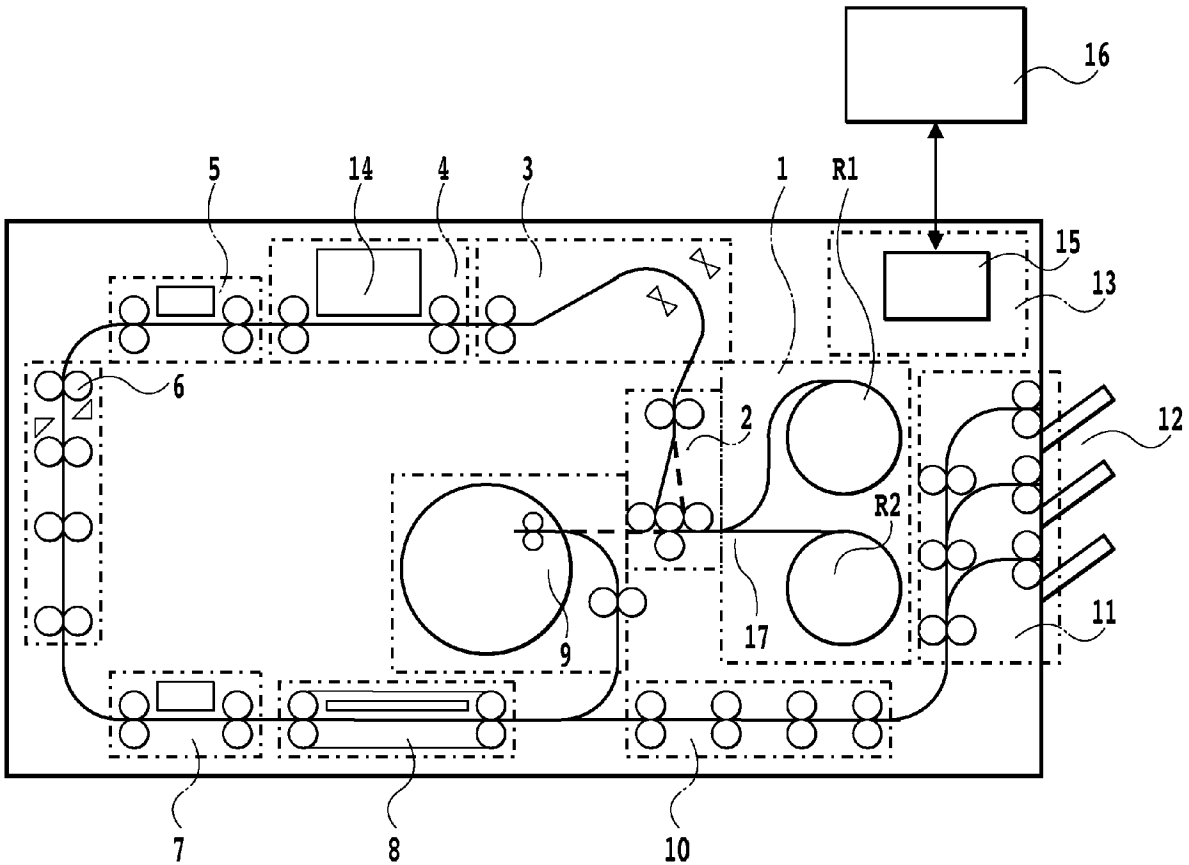
FIG. 1 is a schematic sectional view illustrating internal arrangement of a printing apparatus.

FIG. 1 is a schematic sectional view illustrating an internal arrangement of an ink-jet printing apparatus. The ink-jet printing apparatus includes therein a sheet feeder section 1, a de-curl section 2, a positional deviation removal section 3, a printing section 4, an inspection section 5, a cutter section 6, an information printing section 7, a drying section 8, a sheet winding section 9, a discharge conveyance section 10, a sorter section 11, a discharge tray 12, and a control unit 13. A printing medium (roll of paper), which is fed out from the sheet feeder section 1, is conveyed along a path, which is indicated with a solid line in FIG. 1, by a plurality of conveyance mechanisms like roller pairs or belts which are provided at appropriate points in the apparatus. During conveyance of the sheet, the respective units perform designated operation respectively onto the sheet.

The sheet feeder section 1 is a unit that accommodates continuous sheets (printing medium) wound in a roll-shape and feeds out the sheet therefrom. According to the embodiment, the sheet feeder section 1 is arranged to accommodate two rolls R1 and R2 of paper and is configured so as to selectively pull out and feed the sheet. Here, the number of rolls of paper accommodatable in the sheet feeder section 1 is not limited to two, but may be three or more.

The de-curl section 2 is a unit that reduces a curl (warpage) on a sheet fed out from the sheet feeder section 1. The de-curl section 2 is provided with two pinch rollers with respect to a drive roller so as to switch the path of the sheet depending on the direction of a curl on the sheet. The de-curl section 2 is configured to forcibly pull the sheet so that the sheet passes through a curved path between the rollers while being given with a warpage to a direction opposite to the direction of the curl to thereby reduce the curl on the sheet. The positional deviation removal section 3 is a unit that removes a positional deviation (an inclination with respect to the proper proceeding direction) of the sheet fed from the de-curl section 2. The positional deviation removal section 3 is arranged so as to push a reference side edge of the sheet against a guide member to thereby remove the positional deviation of the sheet.

The printing section 4 is a unit that prints images onto the conveyed sheet using a printing head 14. The printing section 4 is provided with a plurality of conveyance rollers for conveying the sheet. The printing head 14 is a line-type ink-jet printing head having a plurality of nozzles which discharges ink in a drop and which is disposed in a vertical direction in FIG. 1. The nozzles are arranged to cover a maximum width of the sheet to be used. According to the embodiment, seven printing heads 14 are provided to discharge seven types of ink having different color hues. These seven printing heads are disposed parallel to each other along the conveyance direction of the sheet. According to the embodiment, the seven types of ink include C (cyan), M (magenta), Y (yellow), LC (light cyan), LM (light magenta), G (gray) and K (black). Here, according to the invention, the number of colors and the number of printing heads are not limited to seven.

The method of ejecting the ink from the printing head may employ a heating element, a piezo element, a electrostatic element, an MEMS element or the like. Each color ink is supplied to the respective printing heads 14 from ink tanks (not shown) disposed within the apparatus through each ink tube.

The inspection section 5 is a unit that optically detects inspection pattern and/or images printed on the sheet by the printing section 4. The inspection section 5 inspects state of the nozzles on the printing heads 14, the conveyance state of the sheet, the position of images or the like. The cutter section 6 is a unit provided with a mechanical cutter for cutting the printed sheet at a predetermined length. The cutter section 6 is also provided with a plurality of conveyance rollers for conveying the sheet to the next process. The information printing section 7 is a unit that prints printing information such a serial number and/or date on the rear side of the cut sheet. The drying section 8 is a unit that heats the sheet printed by the printing section 4 to dry the imparted ink in a short period of time. The drying section 8 is also provided with conveyance belts and/or conveyance rollers for conveying the sheet to the next process.

The sheet winding section 9 is a unit that, when double-sided printing is carried out, temporarily winds the continuous sheet on which a printing has been made on a first surface (front side). The sheet winding section 9 is provided with a rotating wind-up drum for winding the sheet. The wind-up drum temporarily winds the continuous sheet which has the first surface printed but is not cut yet. After completing the winding of the sheet, the wind-up drum rotates reversely to feed back the sheet therefrom to the de-curl section 2 and then to the printing section 4. In this process, since the sheet is inversed upside down, the printing section 4 carries out printing on the second surface (back surface) which is not provided with printing. The operation of the double-sided printing will be described later in more detail.

The discharge conveyance section 10 is a unit that conveys the sheet, which has been cut by the cutter section 6 and dried by the drying section 8, and sends the sheet to the sorter section 11. The sorter section 11 is a unit that, if necessary, sorts the printed sheets into several groups to discharge the sheets onto different trays in the discharge tray section 12.

The control unit 13 is a unit that controls the printing apparatus entirely. The control unit 13 includes a power supply and a controller 15 equipped with CPUs, memories, and various I/O interfaces. The operation of the printer is controlled according to the instructions sent from the controller 15 or an external device 16 like a host computer or the like which is connected to the controller 15 via an I/O interface.

Basic printing operation of the apparatus will be described below. The printing operation for single-sided printing is different from that for double-sided printing. Respective printing operation will be described.

Figure 2:
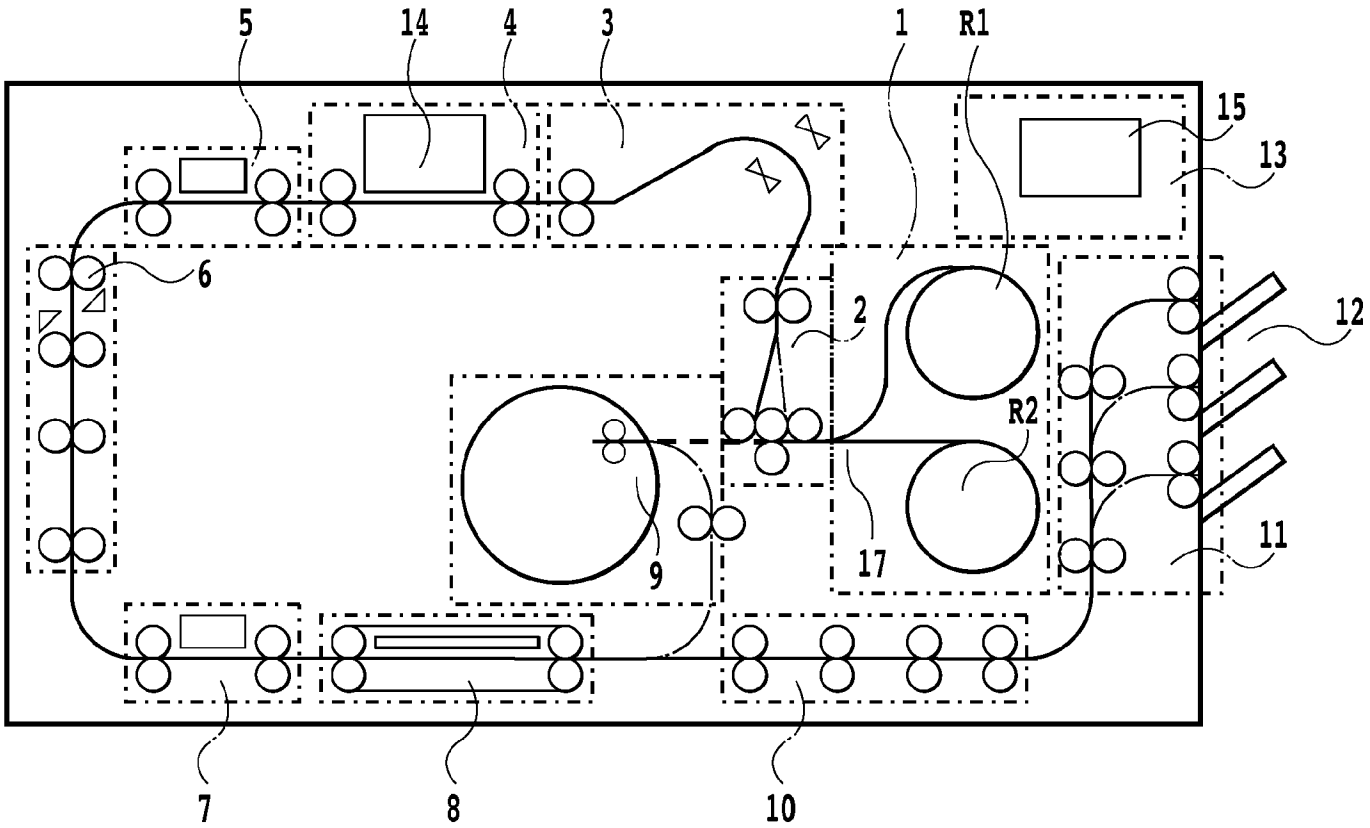
FIG. 2 illustrates an operation of single-sided printing.

FIG. 2 illustrates a conveyance path for single-sided printing. The heavy line indicates a conveyance path from the sheet feeder section 1, from which a sheet is fed out, to the discharge tray section 12 on which the sheet is discharged after being printed. A sheet fed out from the sheet feeder section 1 is subjected to the respective processes by the de-curl section 2 and the positional deviation removal section 3, and then subjected to the printing process on a first surface (front side) by the printing section 4. The printed sheet goes through the inspection section 5, and then is cut to a predetermined length by the cutter section 6. The cut sheet is, if necessary, printed with printing information on the rear side of the sheet by the information printing section 7. Then, the cut sheets are conveyed one by one to the drying section 8 to be dried. After that, the sheets go through the discharge conveyance section 10, and are discharged onto trays 12 in the sorter section 11 and stacked thereon in order.

Figure 3:
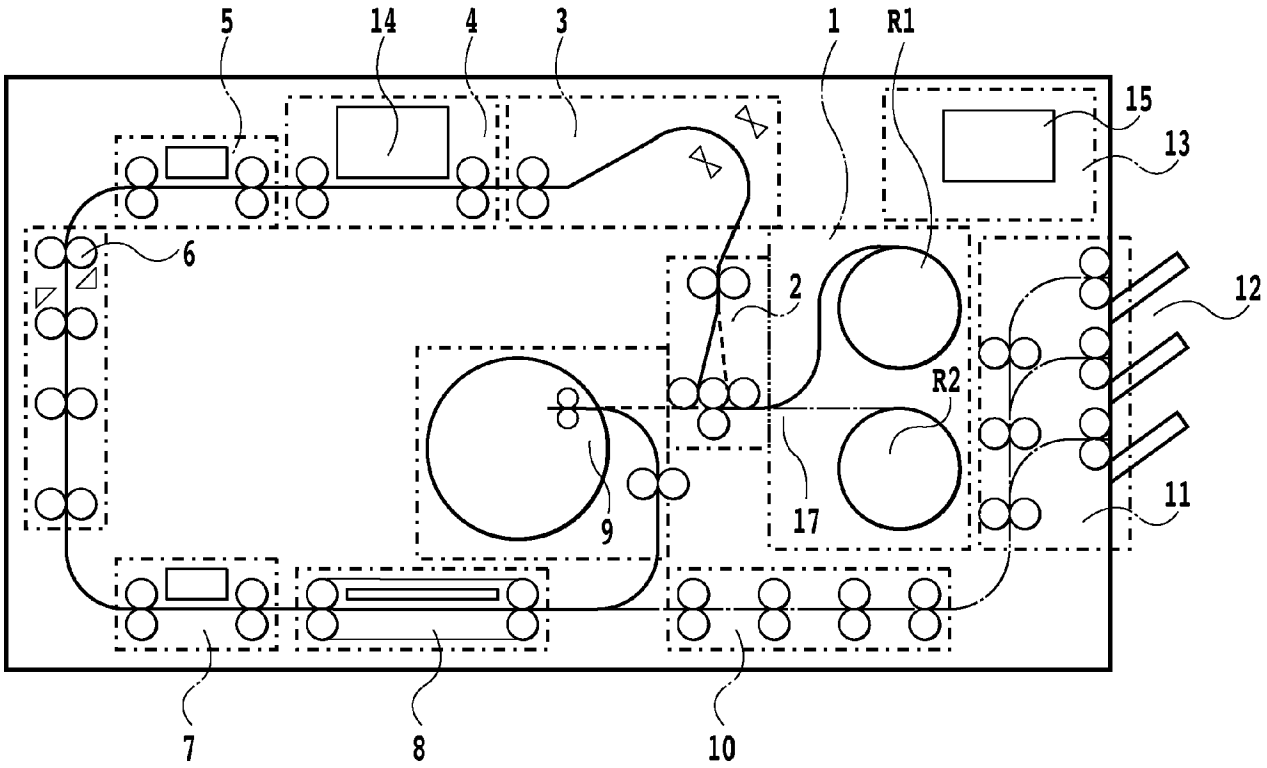
FIG. 3 illustrates an operation of double-sided printing.

FIG. 3 illustrates the operation for double-sided printing. In the double-sided printing, a rear side printing sequence is carried out after the front side printing sequence is completed. In the preceding front side printing sequence, the operations carried out by the respective units from the sheet feeder section 1 to the inspection section 5 are the same as the operations for the above-described single-sided printing excepting the cutter section 6. In the cutter section 6, the cutting operation is not carried out, but the continuous sheet is conveyed to the drying section 8 without being subjected to the cutting operation. After the ink on the first surface (front side) is dried by the drying section 8, the sheet is guided into a path not to the path to the discharge conveyance section 10 but to the sheet winding section 9. The guided sheet is wound onto the wind-up drum rotating forward (counterclockwise in FIG. 2)

in the sheet winding section 9. When the intended printing is completed on the first surface by the printing section 4, the continuous sheet is cut at a tail end of the printing area by the cutter section 6. The continuous sheet positioned at the downstream side (printed side) from the cutter section 6 as viewed in the conveyance direction is completely wound up to the sheet tail end (cut portion) by the sheet winding section 9 through the drying section 8. On the other hand, the continuous sheet positioned at the upstream side from the cut portion as viewed in the conveyance direction is wound back by the sheet feeder section 1 so that the sheet front end (cut portion) does not reside within the de-curl section 2.

After completing the above front side printing sequence, the operation is switched to the rear side printing sequence. The wind-up drum in the sheet winding section 9 rotates in a direction opposite to the winding direction (clockwise direction in FIG. 2). The end of the wound sheet (sheet tail end at the winding operation becomes the sheet front end at the feed-out operation) is fed into the de-curl section 2. The curl removal operation is made by the de-curl section 2 in a direction opposite to the previous direction. The reason of this is that the sheet on the wind-up drum is wound in a state opposite to that of the roll on the sheet feeder section 1 (upside down) and accordingly a curl of opposite direction is imparted. After that, the continuous sheet goes through the positional deviation removal section 3, and then printing is made on the second surface (rear side) by the printing section 4. After being printed, the sheet goes through the inspection section 5 and is cut at a preset length by the cutter section 6. Since the cut sheets have been printed on the both sides, no information is printed by the information printing section 7. The cut sheets are conveyed one by one to the drying section 8, and are discharged in order onto the trays 12 in the sorter section 11 through the discharge conveyance section 10, and are stacked thereon.

In the above-described printing apparatus, the sheet feeder section 1 that has a structure peculiar to the invention will be described in more detail.

Figure 4:
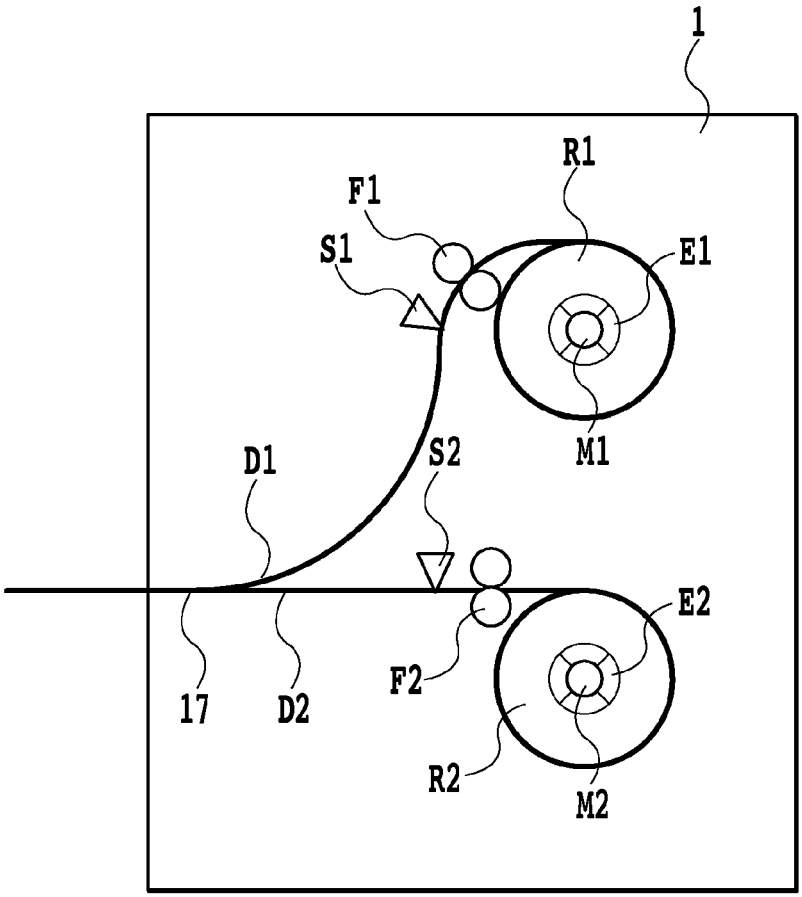
FIG. 4 is an enlarged view of a sheet feeder section according to a first embodiment.

FIG. 4 is an enlarged view of the sheet feeder section 1. The sheet feeder section 1 is able to mount two rolls of paper R1 and R2 at different mounting positions. Each of the sheets fed out from the rolls of paper R1 and R2 proceeds through each of dedicated separate conveyance paths D1 and D2 and reaches a conveyance path merging part 17. Each of the separate conveyance paths D1 and D2 is provided with a conveyance roller F1, F2, which rotates in contact with the roll of paper, and a pinch roller that rotates while pinching a sheet between the conveyance rollers. The control unit 13 controls the rotation of the conveyance rollers F1 and F2 in accordance with printing command to selectively pull out the sheet from either one of the rolls of paper R1 and R2 to feed out the sheet to the conveyance path merging part 17 where the both paths merge with each other. The conveyance paths merged at the conveyance path merging part 17 form one and the same path.

Each of the separate conveyance paths D1 and D2 is provided with a sensor S1, S2 for detecting the front end of the sheet and the width thereof at the upstream side of the conveyance path merging part 17 so as to notify the existence of the roll of paper and the width thereof to the control unit.

At the centers of each of the rolls of paper R1 and R2, there is provided a motor M1, M2 for driving the roll of paper and an encoder E1, E2 respectively. The motors M1 and M2 are used mainly to remove a slack from the roll of paper. Each of the encoders E1 and E2 is used for measuring the rotation amount of the rolls of paper R1, R2.

Figure 5:
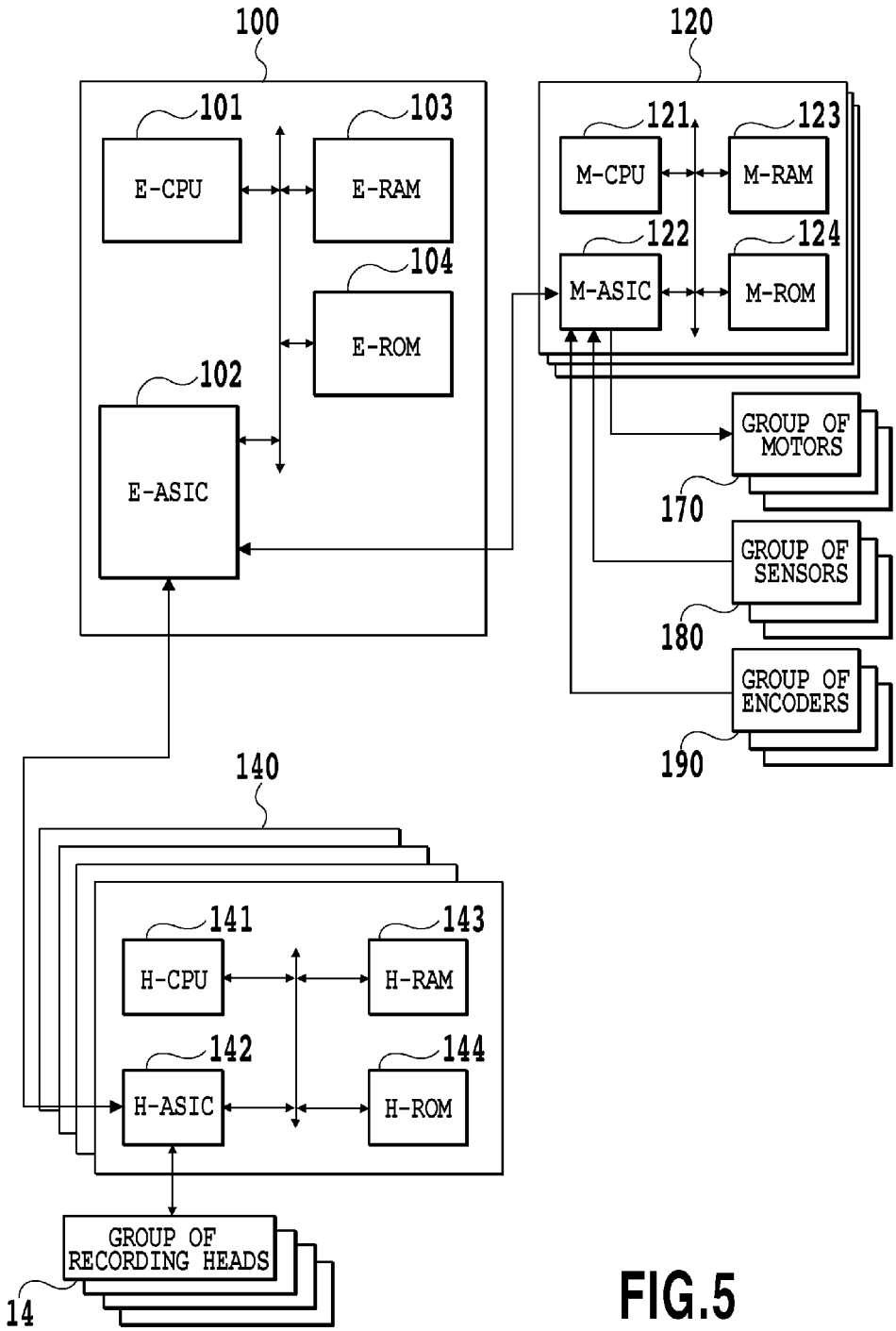
FIG. 5 is a block diagram of a control unit illustrating configuration for controlling respective mechanical units.

FIG. 5 is a block diagram showing the configuration of the controller 15 in the control unit 3 that controls the respective units. The controller 15 includes generally an engine controller 100, a plurality of head controllers 140 connected to the engine controller 100 and a plurality of motor controllers 120. Each of the head controllers 140 is connected via LVDS to the respective printing heads 14 each ejecting color ink. The motor controller 120 is connected via USB to a group of motors 170, a group of various sensors 180, and a group of various encoders 190. The group of motors 170 includes, in addition to the motors M1 and M2 provided at the center of the rolls of paper R1 and R2, conveyance motors that drive the conveyance rollers F1 and F2, a motor that drives the cutter in the cutter section 6. The group of sensors 180 includes, in addition to the sensors S1 and S2 that detect the existence of the sheet and the width thereof, a temperature sensor that measures the ambient temperature.

Figure 6:
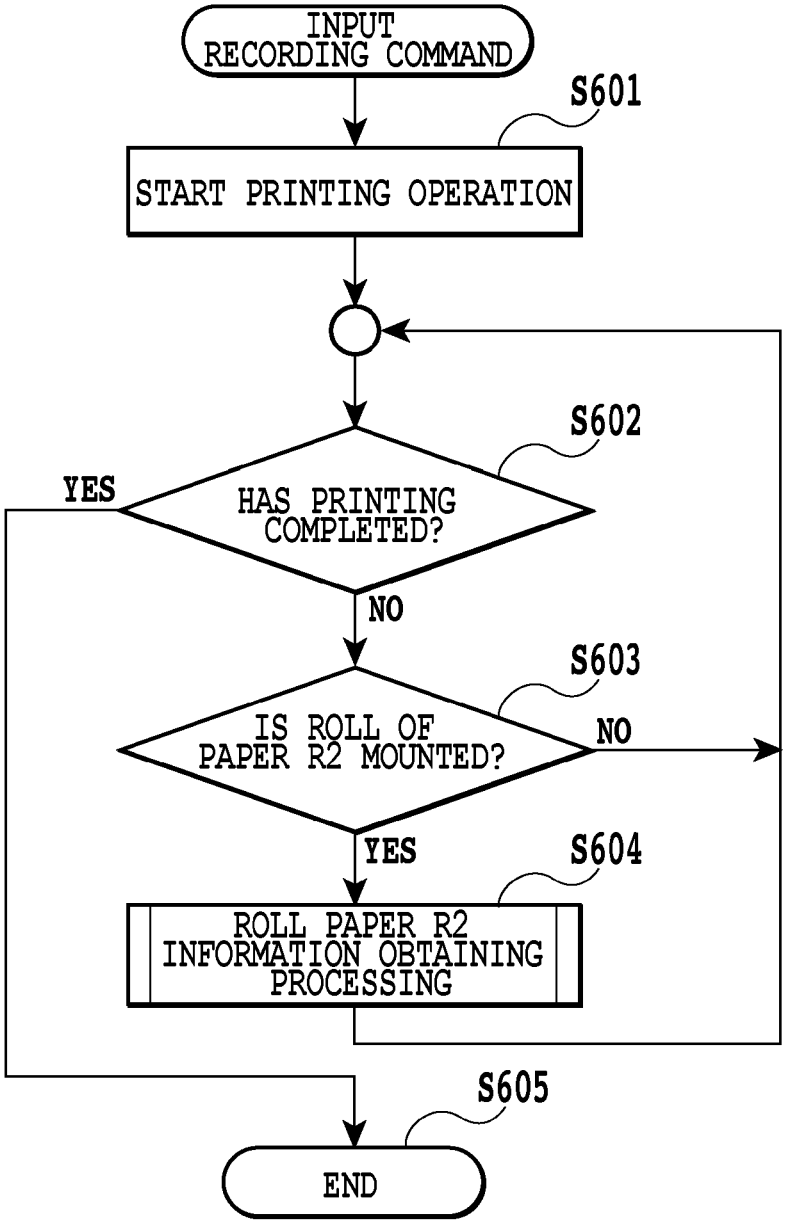
FIG. 6 is a flowchart illustrating a flow of sheet information obtaining process.

FIG. 6 is a flowchart showing a sheet information obtaining processing carried out by the controller 15 during printing on the sheet from the roll of paper R1 to check if the other roll of paper R2 is mounted thereon.

When a printing command is input from the external device 16 and when the command concerns printing on the roll of paper R1, E-CPU 101 on the engine controller 100 causes the respective units to feed out a sheet from the roll of paper R1, to convey the sheet to the printing section 4; and then causes the printing section 4 to start the printing operation (step S601). Specifically, the E-CPU 101 outputs a roll of paper conveyance operation command to the motor controller 120 first. Responding to this, M-CPU 121 controls M-ASIC 122 to drive the motor for rotating the conveyance rollers F1 to convey the sheet from the roll of paper R1 along the conveyance path. On the other hand, the E-CPU 101 controls E-ASIC 102 to read pattern data to be printed in order from a printing command table on E-RAM 103, and transfers the data to the head controller 140. With this operation, the printing head 14 ejects ink and a pattern is printed on the sheet which is fed out and being conveyed from the roll of paper R1.

When the above printing operation is started, at step S602, it is determined if the printing on the roll of paper R1 is completed. When it is determined that the printing has completed, the process proceeds to step S605 and the present processing is terminated. Contrarily, when it is determined that the printing is in progression, the process proceeds to step S603 and it is determined if a new roll of paper R2 is mounted.

At step S603, when it is determined that a new roll of paper is mounted, a predetermined roll paper information obtaining processing is carried out at step S604, and then the process returns to step S602. Contrarily, when it is determined that a new roll of paper is not mounted, the process returns to step S602 immediately. The above process from step S602 to step S604 is carried out during printing operation on the roll of paper R1.

Figure 7:
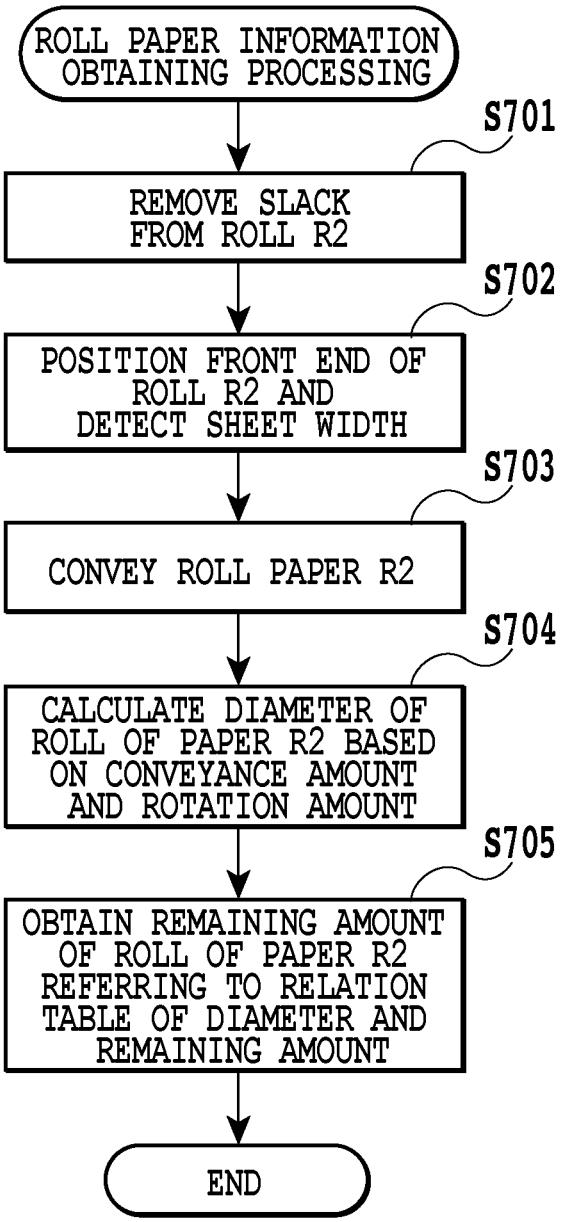
FIG. 7 is a flowchart illustrating a flow of roll of paper information obtaining process.

FIG. 7 is a flowchart showing the steps carried out by the controller 15 in the roll paper information obtaining process. Here, the case where the information concerning the roll of paper R2 is obtained during the printing operation on the sheet from the roll of paper R1 is described. This is the identical for the case where the rolls of paper are inversed.

When the processing is started, the E-CPU 101 for the engine controller 100 transmits a information obtaining process command of the roll of paper R2 to the motor controller 120. With this operation, at step S701, slack removal processing is carried out on the roll of paper R2. Specifically, the front end of the roll of paper R2 is held by a front end holding mechanism (not shown). In this state, the M-CPU 120 causes the motor M2 for the roll of paper R2 to rotate in a direction opposite to the conveyance direction under the control of M-ASIC. According to the embodiment, when the roll of paper R2 is completely wound up by the rotation of motor M2, the printing apparatus is adapted so that only the shaft coupled to the motor M2 performs idling, and thus the roll of paper R2 is stopped from rotating. With this operation, signals which are output by the encoder E2 that operates being linked with the roll of paper R2 are also stopped. With this operation, it is detected that slack has been removed. Thus, by previously removing slack from the roll of paper, based on the information measured by the encoder E2, the conveyance amount of the sheet from the roll of paper R2 can be obtained precisely.

Consequently, at step S702, front end positioning and sheet width measurement of the roll of paper R2 are made. Specifically, the M-CPU 121 controls the M-ASIC 122 to drive the motor M2 so that the conveyance roller F2 starts the conveyance of the roll of paper R2. Then, when the sensor S2 disposed within the separate conveyance path D2 detects the front end of the sheet, the conveyance operation is stopped. According to the embodiment, the sensor S2 is capable of detecting the width of the sheet as well as the existence of sheet. The obtained information is provided to the M-ASIC and the M-ASIC stores the information in M-RAM 123.

At step S703, the sheet from the roll of paper R2 is conveyed within the separate conveyance path D2 until the front end of the roll of paper R2 reaches a point short of the conveyance path merging part 17. Specifically, the M-CPU 121 controls the M-ASIC 122 to drive the conveyer motor to rotate the conveyance rollers F2 so that the front end of the sheet is conveyed a predetermined distance from the position of the sensor S2 to the point short of the conveyance path merging part 17. Since this conveyance operation is carried out until the front end of the roll of paper R2 reaches the point short of the conveyance path merging part 17, this operation can be made without giving any influence to the printing operation on the roll of paper R1 or the conveyance operation thereof. During the above conveyance operation, the encoder E2 measures the rotation amount of the roll of paper R2, and the M-CPU 121 stores the information in the M-RAM 123.

At step S704, based on the conveyance amount and the rotation amount stored in the M-RAM 123, the diameter of the roll of paper R2 is calculated. Since the rotation speed of the conveyance roller F2 driven by the conveyer motor is constant, conveyance speed of the sheet fed out from the roll of paper R2 is also constant. On the other hand, since the diameter of the roll of paper R2 becomes smaller as it is fed out, the rotation speed of the roll of paper R2 is increased. That is, the remaining amount of the roll of paper can be estimated based on the rotation amount of the roll of paper in accordance with a certain amount of conveyance.

FIG. 8A shows a formula used for calculating the diameter of the roll of paper R based on the certain conveyance amount and the rotation amount caused by the conveyance. According to the embodiment, at the mounting of the roll of paper, in addition to the width of the roll of paper obtained at step S702, the remaining amount of the roll of paper R2 is also detected utilizing the formula.

At step S705, referring to the table previously stored in the M-ROM 124, the remaining amount of the roll of paper R2 is obtained based on the diameter obtained at step S704, and is stored in the M-RAM. FIG. 8B shows an example of the table stored in the M-ROM 124. As shown in FIG. 8B, the table previously stores remaining amount of the roll of paper corresponding to the calculated diameter. The relation between the diameter of the roll of paper and the remaining amount thereof varies depending on the characteristics such as thickness and slack tendency of the printing medium such as medium for single-side printing or for double-side printing. Therefore, the relation between the diameter and the remaining amount is preferably prepared in accordance with the types of the printing medium as shown in FIG. 8B.

As described above, at step S703 and step S705, when each of the width information and the remaining amount information of the roll of paper R2 is stored in the M-RAM, the roll paper information obtaining process is terminated.

The width information and the remaining amount information stored in the M-RAM may be notified to the user through a information display like LCD or LED provided to the printing apparatus. When printing is carried out on the roll of paper R2, the roll paper information is effectively utilized for controlling the printing operation by the engine controller 100. For example, the width information may be used for adjusting the printing position so that the provided image is positioned at the center as viewed in the width direction of the sheet. Also, the remaining amount information may be used for determining if the provided image data exceeds the remaining amount of the roll of paper. When the image data exceeds the remaining amount of the roll of paper, the printing operation may be stopped or a notice may be given to the user.

(Second Embodiment)

Figure 9:
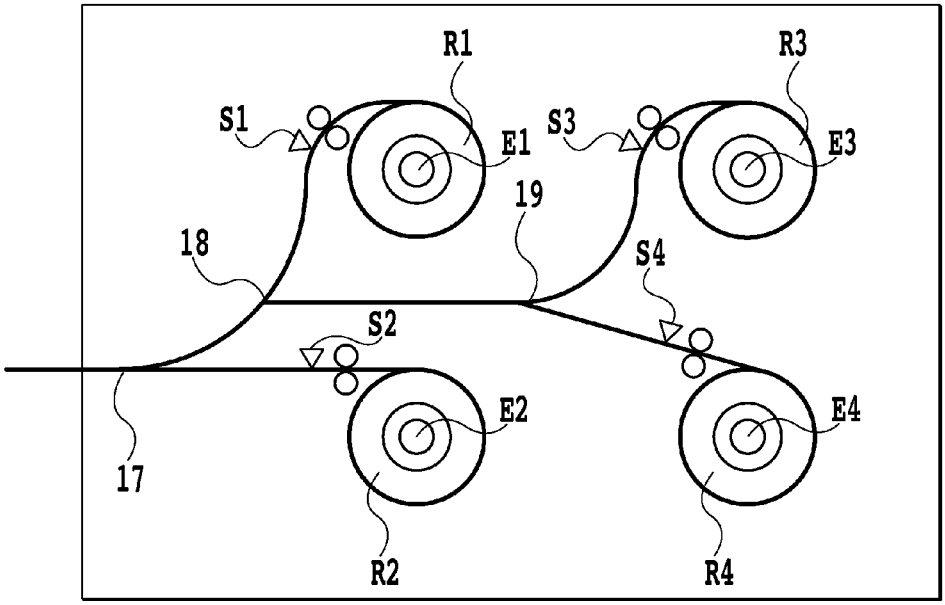
FIG. 9 is an enlarged view of a sheet feeder section provided with three conveyance path merging parts.

FIG. 9 is an enlarged view of a sheet feeder section 1 that is capable of mounting four rolls of paper R1 to R4 and is provided with three conveyance path merging parts 17, 18 and 19. According to this embodiment, the papers from the rolls R3 and R4 are merged with each other at a conveyance path merging part 19; the papers from the rolls R3 and R4 are further merged with the paper from the roll R1 at a conveyance path merging part 18; and further the papers from the rolls R1, R3 and R4 are further merged with the paper from the roll R2 at a conveyance path merging part 17. In this structure also, when encoders E1 to E4 each of which rotates coaxially with each roll of paper are provided and sensors S1 to S4 for detecting the existence and the width of the sheets are provided to each of the separate conveyance paths D1 to D4, the same effect can be obtained as the embodiment described above.

In such structure, for example, when the roll of paper R3 is mounted during an operation of the roll of paper R4, the information of the roll of paper R3 has to be obtained by a roll paper information obtaining process using the separate conveyance path D3 up to the conveyance path merging part 19. However, when the roll of paper R3 is mounted during operation of the roll of paper R2, the roll paper information obtaining process for the roll of paper R3 may be carried out by using a relatively long distance up to the conveyance path merging part 17. In this case, the accuracy of the remaining amount obtaining operation is enhanced by using a longer conveyance path. Therefore, according to the embodiment in which a plurality of conveyance path merging parts is provided as shown in FIG. 9, in accordance with the combination of the roll of paper in conveyance operation and the roll of paper to be mounted, the conveyance distances for remaining amount obtaining operation are different from each other.

In the above-described embodiment, an example, in which sheet width and remaining amount are detected as the roll paper information, is given. However, the roll paper information in the invention is not limited to them. For example, a sensor mechanism which determines the paper type like double-sided printing paper or single-sided printing paper, or gloss paper or non gloss paper may be provided. Further, in addition to the above mechanism, a mechanism which measures the thickness of roll of paper may be provided to determine the type of the printing medium. In any case, in the printing apparatus capable of mounting a plurality of rolls of paper, if a mechanism (various types of sensor encoder, etc.) for detecting the information of the respective rolls of paper in the separate conveyance path at the upstream side of the conveyance path merging part is provided, the working of the invention can be obtained. That is, even when conveyance operation of another roll of paper or printing operation on another roll of paper is in progression, the information of a newly mounted roll of paper can be obtained within the separate conveyance path without suspending the conveyance operation of the other roll of paper.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-188433, filed Aug. 25, 2010, which is hereby incorporated by reference herein in its entirety.

What is claimed is:

1. A printing apparatus, comprising:

a supporting unit configured to support a roll sheet, wherein the supporting mounting unit can support a plurality of roll sheets at a plurality of supporting positions;

an obtaining unit configured to obtain a remaining amount of the roll sheet which is supported mounted at one of the plurality of supporting positions;

a display control unit configured to cause a display screen to display information corresponding to the remaining amount obtained by the obtaining unit; and a printing unit configured to print an image on a sheet pulled out from any of the roll sheets supported by the supporting unit, wherein, the obtaining unit obtains a remaining amount of a second roll sheet which is supported at one of the plurality of supporting positions, even when the printing unit is not printing the image on a sheet pulled out from the second roll sheet and the printing unit is printing the image on a sheet pulled out from a first roll sheet supported mounted at another supporting position, and the display control unit causes the display screen to display information corresponding to the remaining amount of the second roll sheet obtained by the obtaining unit.

2. The printing apparatus according to claim 1, wherein the obtaining unit further obtains an attribute of the second roll sheet different from a remaining amount of the second roll sheet, even when the printing unit is not printing the image on a sheet pulled out from the second roll sheet and the printing unit is printing the image on the sheet pulled out from the first roll sheet.

3. The printing apparatus according to claim 2, wherein the obtaining unit obtains a width of the roll sheet, as the attribute of the roll sheet.

4. The printing apparatus according to claim 2, wherein the obtaining unit obtains a type of the roll sheet, as the attribute of the roll sheet.

5. The printing apparatus according to claim 4, wherein the obtaining unit obtains the type of the roll sheet with a sensor provided in a conveyance path separate from a conveyance path of the other of the plurality of roll sheets.

6. The printing apparatus according to claim 2, further comprising a detecting unit provided in each of a plurality of separate conveyance paths each of which conveys sheets pulled out from the plurality of supported rolls of sheet, wherein the obtaining unit obtains the attribute of the roll sheet from each of the supporting positions, by using the detecting unit.

7. The printing apparatus according to claim 2, wherein the obtaining unit obtains a thickness of the roll sheet, as the attribute of the roll sheet.

8. The printing apparatus according to claim 2, wherein the display control unit causes the display screen to further display the attribute of the roll sheet.

9. The printing apparatus according to claim 2, wherein the printing unit executes printing that is based on the attribute of the roll sheet.

10. The printing apparatus according to claim 1, wherein the obtaining unit obtains a rotation amount of the roll sheet when the sheet from the roll sheet is conveyed using an encoder to thereby determine a remaining amount of the roll sheet.

11. The printing apparatus according to claim 1, further comprising a plurality of separate conveyance paths each configured to convey there through each of sheets pulled out from the plurality of supported rolls of sheet.

12. The printing apparatus according to claim 11, further comprising a conveyance path merging part at which the separate conveyance paths merge with each other.

13. The printing apparatus according to claim 12, further comprising a plurality of conveyance path merging parts.

14. The printing apparatus according to claim 12, wherein the printing unit is located downstream of the conveyance path merging part in a conveyance direction and configured to print an image on a sheet selectively pulled out from the plurality of rolls of sheets.

15. The printing apparatus according to claim 1, further comprising a determining unit configured to determine whether a roll sheet is supported at a supporting position of the plurality of supporting positions of the supporting unit, wherein the obtaining unit obtains a remaining amount of the second roll sheet in response to determination of supporting of the second roll sheet by the determining unit.

16. The printing apparatus according to claim 1, wherein the printing unit determines whether to execute printing on the second roll sheet, based on the remaining amount obtained by the obtaining unit.

17. The printing apparatus according to claim 16, wherein the printing unit executes the determination, based on the remaining amount obtained by the obtaining unit and image data to be printed.

18. The printing apparatus according to claim 1, further comprising a cutter configured to cut a sheet which an image is printed by the printing unit on a first surface, and a drum configure to wind the sheet cut by the cutter, and to feed the wound sheet, wherein the drum winds the sheet by rotating, and feeds the wound sheet by rotating reversely, and wherein the sheet is inverted by rotation of the drum, and the printing unit prints an image on a second surface of the sheet fed by the drum.

19. A method, comprising:

providing a printing apparatus configured to support a plurality of roll sheets at a plurality of supporting positions;

providing a printing unit configured to print a sheet pulled out from any roll sheet at one of the plurality of supporting positions;

a printing step for printing an image, with the printing unit, on a sheet pulled out from a first roll sheet which is supported at a first supporting position of the plurality of supporting positions;

an obtaining step for obtaining an attribute of a second roll sheet which is supported at a second supporting position of the plurality of supporting positions, even when the image is not being printing on a sheet pulled out from the second roll sheet in the printing step and the image is being printed on a sheet pulled out from the first roll sheet in the printing step; and a display control step for causing a display screen to display information corresponding to the attribute obtained in the obtaining step.

20. A printing apparatus, comprising:

a supporting unit configured to support a roll sheet, wherein the supporting mounting unit can support a plurality of roll sheets at a plurality of supporting positions;

an obtaining unit configured to obtain an attribute of the roll sheet which is supported at one of the plurality of supporting positions;

a display control unit configured to cause a display screen to display information corresponding to the attribute obtained by the obtaining unit; and a printing unit configured to print an image on a sheet pulled out from any of the roll sheets supported by the supporting unit, wherein, the obtaining unit obtains an attribute of a second roll sheet which is supported at one of the plurality of supporting positions, even when the printing unit is not printing the image on a sheet pulled out from the second roll sheet and the printing unit is printing the image on a sheet pulled out from a first roll sheet supported mounted at another supporting position, and the display control unit causes the display screen to display information corresponding to the attribute of the second roll sheet obtained by the obtaining unit.

21. The printing apparatus according to claim 20, wherein the obtaining unit obtains a width of the roll sheet, as the attribute of the roll sheet.

22. The printing apparatus according to claim 20, wherein the obtaining unit obtains a type of the roll sheet, as the attribute of the roll sheet.

23. The printing apparatus according to claim 20, wherein the obtaining unit obtains a thickness of the roll sheet, as the attribute of the roll sheet.

24. The printing apparatus according to claim 20, further comprising a plurality of separate conveyance paths each configured to convey sheets pulled out from the plurality of supported rolls of sheet.

25. The printing apparatus according to claim 24, further comprising a detecting unit provided in each of the plurality of separate conveyance paths, wherein the obtaining unit obtains the attribute of the roll sheet from each of the supporting positions, by using the detecting unit.

26. The printing apparatus according to claim 25, further comprising a conveyance unit configured to convey a sheet pulled out from a roll sheet supported by the supporting unit, through each of the plurality of separate conveyance paths, wherein the printing unit prints an image on the sheet conveyed by the conveyance unit.

27. The printing apparatus according to claim 26, wherein the conveyance unit conveys a sheet pulled out from the second roll sheet through a separate conveyance path and the detecting unit provided in the separate conveyance path detects the attribute of the conveyed sheet, even when the printing unit is not printing the image on the sheet pulled out from the second roll sheet and the printing unit is printing the image on a sheet pulled out from the first roll sheet.

28. The printing apparatus according to claim 27, further comprising a conveyance path merging part at which the separate conveyance paths merge with each other, wherein the conveyance unit conveys the sheet until a front end of the sheet reaches a point short of the conveyance path merging part.

29. The printing apparatus according to claim 20, further comprising a determining unit configured to determine whether a roll sheet is supported at a supporting position of the plurality of supporting positions of the supporting unit, wherein the obtaining unit obtains a remaining amount of the second roll sheet in response to determination of supporting of the second roll sheet by the determining unit.

30. The printing apparatus according to claim 20, wherein the printing unit executes printing that is based on the attribute of the roll sheet.

31. The printing apparatus according to claim 20, further comprising a cutter configured to cut a sheet on which an image is printed by the printing unit on a first surface and a drum configure to wind the sheet cut by the cutter, and to feed the wound sheet, wherein the drum winds the sheet by rotating, and feeds the wound sheet by rotating reversely, and wherein the sheet is inverted by rotation of the drum, and the printing unit prints an image on a second surface of the sheet fed by the drum.

* * * * *